US009174361B2

(12) United States Patent
Blank

(10) Patent No.: US 9,174,361 B2
(45) Date of Patent: Nov. 3, 2015

(54) METHOD FOR SIMULTANEOUSLY SLICING A MULTIPLICITY OF WAFERS FROM A CYLINDRICAL WORKPIECE

(71) Applicant: Siltronic AG, Munich (DE)

(72) Inventor: Albert Blank, Obing (DE)

(73) Assignee: SILTRONIC AG, Munich (DE)

( * ) Notice: Subject to any disclaimer, the term of this patent is extended or adjusted under 35 U.S.C. 154(b) by 65 days.

(21) Appl. No.: 13/908,071

(22) Filed: Jun. 3, 2013

(65) Prior Publication Data

US 2013/0333682 A1 Dec. 19, 2013

(30) Foreign Application Priority Data

Jun. 14, 2012 (DE) ..... 10 2012 209 974

(51) Int. Cl.
*B28D 5/04* (2006.01)
*B28D 5/00* (2006.01)

(52) U.S. Cl.
CPC ..... *B28D 5/045* (2013.01); *B28D 5/0082* (2013.01)

(58) Field of Classification Search
CPC ..... B24B 49/006; B24B 51/00; B28D 1/02; B28D 1/06; B28D 1/10; B28D 5/045; B28D 5/0082
USPC ..... 451/5, 8, 11, 41; 125/16.02, 21
See application file for complete search history.

(56) References Cited

U.S. PATENT DOCUMENTS

| | | | | |
|---|---|---|---|---|
| 5,937,844 | A * | 8/1999 | Kiuchi et al. | 125/16.02 |
| 6,941,940 | B1 | 9/2005 | Zavattari et al. | |
| 2006/0107940 | A1 * | 5/2006 | Ji et al. | 125/21 |
| 2006/0249134 | A1 | 11/2006 | Kawasaki et al. | |
| 2008/0011134 | A1 * | 1/2008 | Wiesner | 83/31 |
| 2008/0099006 | A1 | 5/2008 | Huber et al. | |
| 2008/0141994 | A1 * | 6/2008 | Skovgaard-Soerensen et al. | 125/12 |
| 2013/0206126 | A1 * | 8/2013 | Pietsch | 125/21 |

FOREIGN PATENT DOCUMENTS

| | | | |
|---|---|---|---|
| CN | 1780717 | A | 5/2006 |
| CN | 101138869 | A | 3/2008 |
| CN | 101168270 | A | 4/2008 |
| DE | 102005007312 | A1 | 11/2005 |
| DE | 102004036720 | A1 | 3/2006 |
| DE | 102006032432 | B3 | 9/2007 |
| EP | 0856388 | A2 | 8/1998 |
| JP | 62-271668 | A | 11/1987 |

(Continued)

*Primary Examiner* — Maurina Rachuba
*Assistant Examiner* — Marcel Dion
(74) *Attorney, Agent, or Firm* — Leydig, Voit & Mayer, Ltd.

(57) ABSTRACT

A method for simultaneously slicing a multiplicity of wafers from a substantially circular-cylindrical workpiece that is connected to a sawing strip includes executing a relative movement between the workpiece and a wire gang of a wire saw with the aid of a forward feed device with a defined forward feed rate so as to slice the wafers. The forward feed rate is varied through the course of the method and includes being set to a value $v_1$ at a cutting depth of 50% of the workpiece diameter. Subsequently, the forward feed rate is to a value $v_2>1.15\times v_1$ as the forward feed rate passes through a local maximum. The forward feed rate is set to a value $v_3<v_1$ when the wire gang first comes into contact with the sawing strip. The forward feed rate is increased to a value $v_5>v_3$.

17 Claims, 1 Drawing Sheet

(56) References Cited

FOREIGN PATENT DOCUMENTS

| | | | |
|---|---|---|---|
| JP | 02-274460 | A | 11/1990 |
| JP | 2000-042896 | A | 2/2000 |
| JP | 2001-293719 | A | 10/2001 |
| JP | 2006-148068 | A | 5/2006 |
| TW | 499353 | B | 8/2002 |
| TW | 527268 | B | 4/2003 |
| WO | WO 0191982 | A1 | 12/2001 |

* cited by examiner

METHOD FOR SIMULTANEOUSLY SLICING A MULTIPLICITY OF WAFERS FROM A CYLINDRICAL WORKPIECE

CROSS REFERENCE TO RELATED APPLICATIONS

This application claims priority to German Patent Application No. DE 10 2012 209 974.3, filed Jun. 14, 2012, which is hereby incorporated by reference herein in its entirety.

FIELD

The invention relates to a method for simultaneously slicing a multiplicity of wafers from a cylindrical workpiece, in particular a workpiece consisting of semiconductor material, in which the workpiece and a wire gang of a wire saw execute a relative movement directed perpendicularly to the longitudinal axis of the workpiece with the aid of a forward feed device, by which the workpiece is guided through the wire gang.

BACKGROUND

Semiconductor wafers are generally produced by slicing a cylindrical single-crystal or polycrystalline workpiece of the semiconductor material with the aid of a wire saw, simultaneously into a multiplicity of semiconductor wafers in one working step.

The standard components of these wire saws include a machine frame, a forward feed device, and a sawing tool which consists of a gang of parallel wire sections. The workpiece is fixed on a so-called sawing strip, generally by cementing or adhesive bonding. The sawing strip is in turn fastened on a mounting plate, in order to clamp the workpiece in the wire saw.

The wire gang of the wire saw is generally formed by a multiplicity of parallel wire sections, which are tensioned between at least two wire guide rolls, the wire guide rolls being rotatably mounted and at least one of them being driven. The wire sections generally belong to a single finite wire, which is guided spirally around the roll system and is unwound from a stock roll onto a receiver roll.

During the sawing process, the forward feed device induces a relative movement of the wire sections and the workpiece directed against one another. As a result of this forward feed movement, the wire, on which a sawing suspension is applied, works to form parallel sawing kerfs through the workpiece. The sawing suspension, which is also referred to as a slurry, contains abrasive particles, for example consisting of silicon carbide, which are suspended in a liquid. A sawing wire with firmly bound abrasive particles may also be used. In this case, it is not necessary to apply a sawing suspension. It is merely necessary to supply a liquid cooling lubricant, which protects the wire and the workpiece against overheating and at the same time transports workpiece swarf out from the sawing kerfs.

The production of semiconductor wafers from cylindrical semiconductor material, for example from a single crystal, places stringent requirements on the sawing method. The aim of the sawing method is generally that each sawn semiconductor wafer should have two surfaces which are as flat as possible and are mutually parallel.

Besides the thickness variation, the planarity of the two surfaces of the semiconductor wafer is of great importance. After a semiconductor single crystal, for example a silicon single crystal, has been sliced by means of a wire saw, the wafers thereby produced have a wavy surface. This waviness may be partially or fully removed in the subsequent steps, for example grinding or lapping, depending on the wavelength and amplitude of the waviness as well as on the depth of the material removal. In the least favorable case, residues of this waviness may still be detected even after polishing on the finished semiconductor wafer, where they have a detrimental effect on the local geometry. At different positions on the sawn wafers, these waves occur to different degrees. Particularly critical in this case is the end region of the cut in which particularly pronounced waves or grooves may occur, which are even detectable on the end product depending on the nature of the subsequent steps.

From DE102005007312A1, it is known that the wave in the end region of the cut, which occurs in sawing processes according to the prior art, is particularly pronounced for the wafers which have been sliced at the ends of the cylindrical workpiece. In the middle of the workpiece (in the axial direction), on the other hand, the sliced wafers have virtually no wave in the end region of the cut. Furthermore, the axial dynamic pressure gradient generated by the sawing suspension has been identified as a cause of the wave occurring at the end of the sawing process. According to DE102005007312A1, the amount of sawing suspension which is applied to the wire gang is therefore reduced, and the waviness of the sawn semiconductor wafers is thereby reduced in the end region of the cut. It has, however, been found that this measure is not sufficient to satisfy the increasing requirements on the local geometry. In particular, the formation of sawing grooves in the end region is not reliably prevented.

DE102006032432B3 discloses a method in which a sawing strip having oblique side faces is used, in order to reduce the waviness at the end of the cut when the wire passes through not only the workpiece but also the sawing strip. This modified sawing strip also does not prevent the formation of sawing grooves at the end of the cut. Furthermore—particularly in the case of sawing strips composed of a plurality of different materials—additional processing steps are required during the production of the sawing strip, which increases the auxiliary material costs for the sawing process.

Methods are likewise known in which the plane-parallelism of the sawn wafers is improved by varying the workpiece forward feed rate as a function of time. EP856388A2 discloses inter alia a method in which the workpiece forward feed rate is initially reduced as a function of the cutting depth until a cutting depth of about 70% of the workpiece diameter is reached, subsequently reincreased slightly and reduced again at the end. This method makes it possible to produce wafers having a uniform thickness, although the regions of the wafers which correspond to the first and last ten percent of the cutting depth have a significantly smaller thickness. EP856388A2 does not, however, mention any measures for avoiding sawing grooves which specifically occur within the last ten percent of the cutting depth.

SUMMARY

In an embodiment, the present invention provides a method for simultaneously slicing a multiplicity of wafers from a substantially circular-cylindrical workpiece that is connected to a sawing strip includes executing a relative movement between the workpiece and a wire gang of a wire saw with the aid of a forward feed device with a defined forward feed rate, by which the workpiece is guided through the wire gang so as to be sliced into a plurality of wafers. The forward feed rate is varied through the course of the method and includes being set to a value $v_1$ at a cutting depth of 50% of the workpiece diameter. Subsequently the forward feed rate is to a value $v_2 \geq 1.15 \times v_1$ as the forward feed rate passes through a local maximum. The forward feed rate is then set to a value $v_3 < v_1$ at a time when the wire gang first comes into contact with the sawing strip. The forward feed rate is increased to a value $v_5 > v_3$.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION OF THE INVENTION

An aspect of the present invention is to avoid sawing grooves formed in the end region of the cut as far as possible.

This is achieved by a method for simultaneously slicing a multiplicity of wafers from a substantially circular cylindrical workpiece, in which the workpiece, connected to a sawing strip, and a wire gang of a wire saw execute a relative movement directed perpendicularly to the longitudinal axis of the workpiece with the aid of a forward feed device with a defined forward feed rate, by which the workpiece is guided through the wire gang and is thereby sliced into a multiplicity of wafers, wherein the forward feed rate is varied in the course of the method in such a way that:

- it has a value $v_1$ at a cutting depth of 50% of the workpiece diameter,
- next, with a value $v_2 > 1.15 \times v_1$, it passes through a local maximum,
- subsequently, at the time when the wire gang comes in contact with the sawing strip for the first time, it takes a value $v_3 < v_1$, and
- it is then increased to a value $v_5 > v_3$.

Figure 1:
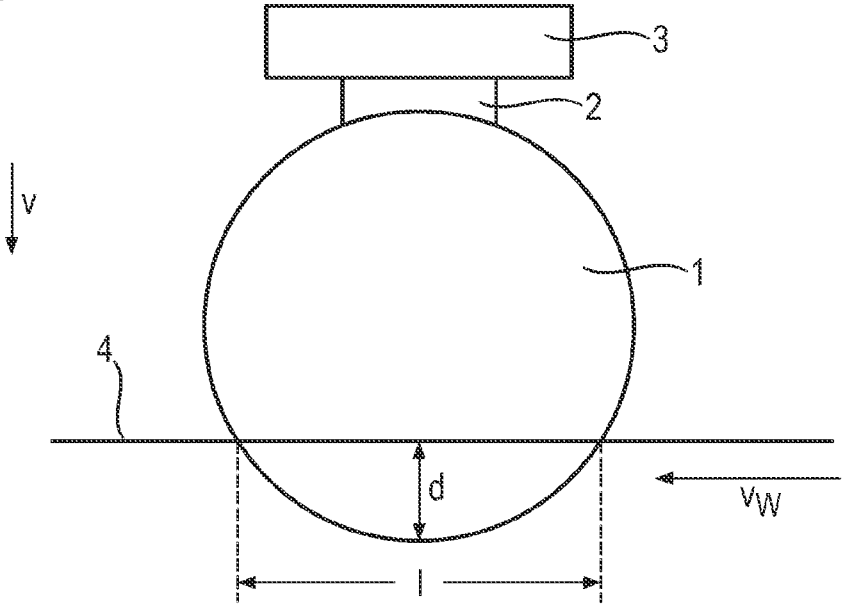
FIG. 1 illustrates the geometrical quantities used to describe the invention.

The invention relates to a wire sawing method, as described in the introduction to the description and schematically represented in FIG. 1. FIG. 1 represents the workpiece 1, which has the shape of a circular cylinder. It is fixed on a sawing strip 2, which is in turn clamped in the wire saw by means of a mounting plate 3. The wire gang is formed by a multiplicity of wire sections 4 extending parallel (lying next to one another in FIG. 1). The wire sections 4 move with a wire speed $v_w$ parallel to the longitudinal direction of the wire sections 4. By means of a forward feed device (not represented), the arrangement consisting of the workpiece 1, sawing strip 2 and mounting plate 3 is moved with a forward feed rate v relative to the wire gang formed by the wire sections 4. Owing to the wire speed $v_w$, the abrasives transported with the sawing wire can exert their abrasive effect on the workpiece 1, so that a sawing kerf is formed in the workpiece 1 along each wire section 4. Owing to the relative movement taking place with the forward feed rate v, in the course of the sawing process the wire sections 4 work deeper and deeper into the workpiece 1 until, at the end of the sawing process, it is completely separated into a multiplicity of wafers, which are then only connected to the mounting plate like the teeth of a comb via the remaining parts of the sawing strip.

According to the invention, the forward feed rate v is varied in a defined way in the course of the sawing process. Here, the forward feed rate v is intended to mean the relative speed with which the wire gang as a whole and the workpiece 1 are moved relative to one another. This relative movement generally takes place perpendicularly to the plane defined by the wire gang's wire sections 4 running parallel.

The prior art already describes methods in which the forward feed rate is varied in the course of the sawing process. In contrast to the method according to the invention, these do not take into account the fact that particularly pronounced grooves can occur on the surface of the sawn workpiece at the position where the sawing wire in addition to the workpiece also cuts through the sawing strip. The present invention for the first time provides a method which reduces these grooves by a defined variation of the forward feed rate.

EP856388A2 has already disclosed a method in which the forward feed rate is reduced continuously, and preferably degressively, from the start of the sawing process, at least until the maximum engagement length is reached.

The engagement length 1 is intended in this description to mean the length of a wire section 4 which, with the current position of the wire gang relative to the workpiece 1, is in contact with the workpiece 1, i.e. it extends through the sawing kerf. For a workpiece 1 in the form of a circular cylinder, the engagement length therefore increases from zero at the start of the process to its maximum engagement length in the middle of the process. The maximum engagement length corresponds to the diameter of the circular cylinder. After the maximum is reached, the engagement length 1 decreases until, at the end of the process, the wire emerges from the workpiece and an engagement length of zero is again reached.

Figure 2:
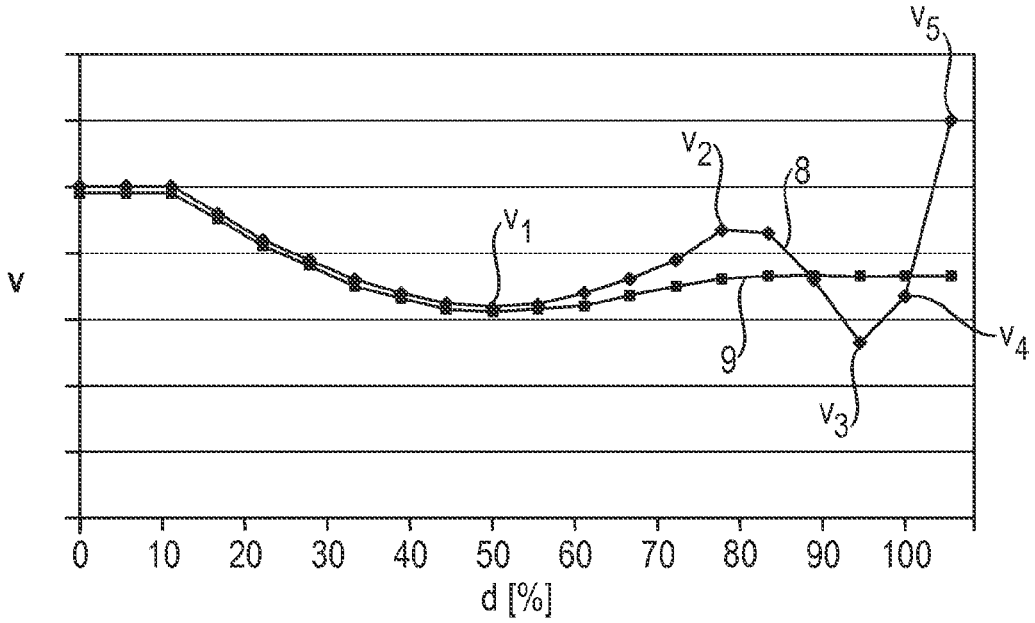
FIG. 2 shows a comparison of a forward feed rate profile according to the invention with one not according to the invention.

The cutting depth d is intended to mean the current depth of the sawing kerfs. It corresponds to the distance which the wire gang has already travelled through the workpiece 1, perpendicularly to the plane defined by the wire gang. At the start of the sawing process, the cutting depth is zero, while at the end it corresponds to the diameter of the circular-cylindrical workpiece. In FIG. 2, the sawing depth d is therefore indicated as a percentage of the workpiece diameter.

In the case of a circular-cylindrical workpiece, the maximum engagement length is therefore reached when the cutting depth corresponds to 50% of the workpiece diameter.

Curve 8 in FIG. 2 shows a profile, according to the invention, of the forward feed rate v as a function of the cutting depth d indicated as a percentage of the workpiece diameter. Curve 9 shows a profile of the forward feed rate v not according to the invention.

The reduction, known from the prior art, of the forward feed rate until the maximum engagement length is reached at a 50% cutting depth serves to avoid thickness variations—in particular, the formation of a wedge-shaped thickness profile is thereby intended to be avoided—and is therefore likewise preferred in the context of the method according to the invention. In particular, it is advantageous to vary the forward feed rate v as a function of the engagement length 1 in such a way that the removal rate (i.e. the volume of material removed per unit time) remains substantially constant. The removal rate is proportional to the product: engagement length x forward feed rate. The forward feed rate is therefore preferably varied as a function of the engagement length 1 in such a way that this product remains substantially constant.

At a cutting depth of 50% of the workpiece diameter, the forward feed rate v has a value $v_1$ (see FIG. 2) which will be used below as a reference value for describing the forward feed rate profile according to the invention. This value corresponds to a local minimum when the variation of the forward feed rate, up to a cutting depth which corresponds to more than 50% of the workpiece diameter, is determined in the manner described above merely by the engagement length in order to keep the removal rate constant. The local minimum may however—if other influencing factors in the variation of the forward feed rate are also taken into account, as for example according to EP856388A2—lie at a different position. The local minimum preferably lies at between 40 and 60% of the cutting depth. For describing the profile according to the invention of the forward feed rate v, however, the value $v_1$ which is reached at the cutting depth of 50% is taken into account in every case.

Preferably, the profile of the forward feed rate as a function of the cutting depth has a mirror-symmetrical profile with respect to the local minimum described above in a cutting depth range from 30 to 70%, and particularly preferably from 25 to 75%, of the workpiece diameter. The mirror-symmetrical profile is in any case established so long as the forward feed rate is varied, in the manner described above, in such a way that the removal rate remains constant.

After passing through the local minimum, the forward feed rate is reincreased according to the invention, and it is reduced again before reaching the position at which the sawing wire comes in contact with the sawing strip for the first time, so that a local maximum is reached between the position of maximum engagement length at 50% cutting depth and sawing into the sawing strip. The value of the forward feed rate at the position of the local maximum will be referred to below as $v_2$. According to the invention, the value V2 is greater than the 50% cutting depth $v_1$ value at least by a factor of 1.15, preferably at least by a factor of 1.2, and particularly preferably by a factor of 1.25. It has been found that, in order to ensure a good cutting quality, it is not necessary for the forward feed rate to be kept in a low range comparable with the value $v_1$ after passing through the local minimum in the middle of the sawing process. A flatter profile of the forward feed rate, for example according to the curve 9 in FIG. 2, merely lengthens the process duration, which is avoided according to the invention. If the forward feed rate is varied in the manner described above as being preferable, in such a way that the removal rate remains constant, and if the mirror-symmetrical profile of the forward feed rate resulting therefrom is maintained up to a cutting depth of 70 or even 75%, the above-specified factors of 1.15, 1.2 or even 1.25 can readily be achieved.

After passing through the local maximum with the forward feed rate $v_2$, the forward feed rate is reduced again so that when the wire gang enters the sawing strip, i.e. at the time when the wire sections of the wire gang come in contact with the sawing strip for the first time, the forward feed rate takes a value $v_3$ which is less than the reference rate $v_1$. It has been found that, in order to avoid sawing grooves in the end region of the cut, just before the wire gang enters the sawing strip it is necessary to reduce the forward feed rate substantially stronger than it is known from the prior art. Preferably, the forward feed rate satisfies $v_3 \leq 0.9 \times v_1$.

The value $v_3$ constitutes a local minimum, i.e. this value is preferably not reached until shortly before the wire gang enters the sawing strip, and shortly after entry the forward feed rate immediately begins to be increased again.

In any event, at a later time (preferably at or shortly before the end of the sawing process) a value $v_5$ is reached which is higher than $v_3$. It has been found that, after the wire gang has entered the sawing strip, it is not detrimental to the cutting quality if the forward feed rate is increased again. In order to avoid an unnecessarily long process duration, according to the invention it has therefore been established that $v_5 > v_3$ should be satisfied. Preferably, after the wire gang enters the sawing strip, the forward feed rate is even increased to such an extent that $v_5 > v_2$.

At the time when the workpiece has been sliced through fully and after which the wire gang is only in contact with the sawing strip, the forward feed rate has the value $v_4$, which preferably lies between the values $v_3$ and $v_5$. This is because the forward feed rate can readily be increased further after fully slicing through the workpiece, without this having any more influence on the surface of the sawn wafers (i.e. $v_5 > v_4$). On the other hand, however, the forward feed rate may already start to be moderately increased again immediately after the wire gang enters the sawing strip, without significantly impairing the cutting quality (i.e. $v_4 > v_3$).

Preferably, a continuous acceleration takes place from entry of the wire gang into the sawing strip until the end of the sawing process. Depending on the structure of the sawing strip, this may also be carried out in several stages with different accelerations in order to accommodate the different material properties of the materials contained in the sawing strip. The softer the respective material of the sawing strip is, the greater the forward feed rate can be.

If the forward feed rate is significantly reduced before sawing into the sawing strip, this leads to a significant reduction of the sawing grooves formed on the workpiece in this region. It has been established that, in order to substantially avoid grooves in the region of the sawing strip, a reduced forward feed rate in the region described above is sufficient. A forward feed rate reduced over a longer period of time, on the other hand, does not lead to further improvements. Since a forward feed rate reduced noticeably according to the invention would significantly lengthen the duration of the sawing process if it were maintained over a prolonged period of time, this period of time is kept as short as possible according to the invention. In this way, the local waviness in the region of the sawing strip can be avoided without lengthening the process time.

EXAMPLES

A large number of single-crystal ingot portions consisting of silicon, having a diameter of 125 mm or 150 mm, were sliced into silicon wafers using a commercially available wire saw. A steel sawing wire and a sawing suspension consisting of silicon carbide suspended in glycol were used as auxiliary materials. The forward feed rate was varied on the one hand according to the curve 8 represented in FIG. 2 (according to the invention) and on the other hand according to the curve 9 (not according to the invention). Apart from this difference, both tests were carried out in the same way. In each case, 100 ingot portions were cut according to the invention and not according to the invention.

After removing the remaining parts of the sawing strip and cleaning, visual inspection was carried out on the sawn wafers. In addition, some of the wafers were examined using a geometry measuring instrument which acquires a height profile along a diameter of the wafer by means of a mechanical probe, the direction of the scan being selected parallel to the forward feed of the wire gang during the sawing process.

Example

In the example according to the invention, the forward feed rate was varied according to the curve 8 represented in FIG. 2.

No conspicuous sawing grooves were found in the visual inspection of the sawn wafers. A waviness of not more than 12 μm was determined using the geometry measuring instrument.

Comparative Example

In the comparative example not according to the invention, the forward feed rate was varied according to the curve 9 represented in FIG. 2. The sawing process overall lasted longer than in the example according to the invention, by 5% for a diameter of 150 mm and by 10% for a diameter of 125 mm.

In the visual inspection, particularly pronounced sawing grooves were found for 20% of all the wafers in the region of the wafers which came in contact with the sawing wire toward the end of the sawing process. A waviness of up to 25 μm was determined using the geometry measuring instrument, which was caused by the particularly pronounced sawing grooves in the ingot portion region connected to the sawing strip during the sawing process.

The method according to the invention therefore leads to a significant improvement of the cutting quality in the end region of the sawing process, even though the overall duration of the sawing process was actually reduced slightly.

The method according to the invention may be used during the wire sawing of cylindrical workpieces. It is particularly suitable for workplaces in the form of a circular cylinder. The workpieces may consist of a brittle material, for example a semiconductor material such as silicon, preferably single-crystal silicon. The method may be used in wire sawing with fixed abrasive, but preferably in wire sawing with a sawing suspension and a sawing wire without fixed abrasives.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

The invention claimed is:

1. A method for simultaneously slicing a multiplicity of wafers from a substantially circular-cylindrical workpiece that is connected to a sawing strip, the method comprising:

executing a relative movement between the workpiece and a wire gang of a wire saw in a direction perpendicular to a longitudinal axis of the workpiece with the aid of a forward feed device with a defined forward feed rate, by which the workpiece is guided through the wire gang so as to be sliced into a plurality of wafers; and varying the forward feed rate through the course of the method including:

setting the forward feed rate to a value $v_1$ at a cutting depth of 50% of the workpiece diameter;

after reaching the cutting depth of 50% , increasing the forward feed rate to a value $v_2 \geq 1.15 \times v_1$ as a local maximum;

subsequently to increasing the forward feed rate to the local maximum, decreasing the forward feed rate to a value $v_3 < v_1$ at a time when the wire gang first comes into contact with the sawing strip; and subsequent to coming into contact with the sawing strip, increasing the forward feed rate to a value $v_5 > v_3$.

2. The method as recited in claim 1, wherein the forward feed rate has a local minimum at a cutting depth of from 40 to 60% of the workpiece diameter.

3. The method as recited in claim 2, wherein an xy-plot of the forward feed rate (y)as a function of cutting depth percent (x), has a symmetrical profile with respect to the local minimum in a cutting depth range from 30 to 70% of the workpiece diameter.

4. The method as recited in claim 3, wherein the xy-plot has a symmetrical profile with respect to the local minimum in a cutting depth range from 25% to 75% of the workpiece diameter.

5. The method as recited in claim 1, wherein $v_2 \geq 1.2 \times v_1$.

6. The method as recited in claim 5, wherein $v_2 \geq 1.25 \times v_1$.

7. The method as recited in claim 1, wherein $v_3 \leq 0.9 \times v_1$.

8. The method as recited in claim 1, wherein the forward feed rate has a value $v_4$ at the time when the wire gang emerges from the workpiece, wherein $v_3 < v_4 < v_5$.

9. The method as recited in claim 1, wherein $V_5 > V_2$.

10. The method as recited in claim 1, wherein an xy-plot of the forward feed rate (y) as a function of a cutting depth percent (x) includes a local minimum at the value $v_1$ and a local maximum at the value $v_2$ along the cutting depth percent, and wherein the xy-plot has a mirror-symmetrical profile about the local minimum in a cutting depth range from 30% to 70% of the workpiece diameter.

11. The method as recited in claim 1, wherein an xy-plot of the forward feed rate (y) as a function of a cutting depth percent (x) includes a local minimum at the value $v_1$ and a local maximum at the value $v_2$ along the cutting depth percent, and wherein the xy-plot has a mirror-symmetrical profile about the local minimum in a cutting depth range from 25% to 75% of the workpiece diameter.

12. The method as recited in claim 2, wherein the forward feed rate decreases in a cutting depth range of from 30% to 50% of the workpiece diameter.

13. The method as recited in claim 2, wherein the forward feed rate increases in a cutting depth range of from 50% to 70% of the workpiece diameter.

14. The method as recited in claim 2, wherein the forward feed rate decreases in a cutting depth range of from 30% to 50% of the workpiece diameter, and wherein the forward feed rate increases in a cutting depth range of from 50% to 70% of the workpiece diameter.

15. The method as recited in claim 3, wherein the forward feed rate decreases in a cutting depth range of from 25% to 50% of the workpiece diameter.

16. The method as recited in claim 3, wherein the forward feed rate increases in a cutting depth range of from 50% to 75% of the workpiece diameter.

17. The method as recited in claim 3, wherein the forward feed rate decreases in a cutting depth range of from 25% to 50% of the workpiece diameter, and wherein the forward feed rate increases in a cutting depth range of from 50% to 75% of the workpiece diameter.

* * * * *